US006484127B1

(12) United States Patent
Langervik

(10) Patent No.: US 6,484,127 B1
(45) Date of Patent: Nov. 19, 2002

(54) OIL MAINTENANCE INDICATOR

(75) Inventor: Dennis Langervik, Greensboro, NC (US)

(73) Assignee: Volvo Trucks North America, Inc., Greensboro, NC (US)

( * ) Notice: Subject to any disclaimer, the term of this patent is extended or adjusted under 35 U.S.C. 154(b) by 105 days.

(21) Appl. No.: 09/722,920

(22) Filed: Nov. 27, 2000

(51) Int. Cl.[7] ..... G06F 11/30; G06F 17/40

(52) U.S. Cl. ..... 702/184; 702/177; 702/187; 340/451

(58) Field of Search ..... 702/33–35, 108, 702/50, 113, 114, 127, 138, 140, 176–178, 182–184, 187, 188; 340/457.4, 451, 450.3; 701/29, 30, 31, 34; 73/49.7

(56) References Cited

U.S. PATENT DOCUMENTS

| | | | | |
|---|---|---|---|---|
| 4,706,193 A | | 11/1987 | Imajo et al. | 701/30 |
| 4,742,476 A | * | 5/1988 | Schwartz et al. | 123/196 S |
| 4,862,393 A | | 8/1989 | Reid et al. | 701/30 |
| 4,926,331 A | | 5/1990 | Windle et al. | 701/35 |
| 4,933,852 A | | 6/1990 | Lemelson | 701/30 |
| 5,006,829 A | | 4/1991 | Miyamoto et al. | 340/459 |
| 5,046,007 A | * | 9/1991 | McCrery et al. | 307/10.1 |
| 5,058,044 A | | 10/1991 | Stewart et al. | 702/184 |
| 5,173,856 A | | 12/1992 | Purnell et al. | 701/35 |
| 5,365,436 A | | 11/1994 | Schaller et al. | 701/33 |
| 5,541,840 A | | 7/1996 | Gurne et al. | 701/33 |
| 5,592,395 A | | 1/1997 | Braun et al. | 702/50 |
| 5,642,284 A | | 6/1997 | Parupalli et al. | 701/30 |
| 5,917,408 A | | 6/1999 | Cardillo et al. | 340/439 |
| 5,938,716 A | | 8/1999 | Shutty et al. | 701/115 |
| 5,957,986 A | | 9/1999 | Coverdill | 701/35 |
| 5,995,898 A | | 11/1999 | Tuttle | 701/102 |
| 6,026,784 A | | 2/2000 | Weisman et al. | 123/436 |
| 6,028,537 A | | 2/2000 | Suman et al. | 340/988 |
| 6,208,245 B1 | * | 3/2001 | Post et al. | 340/438 |

FOREIGN PATENT DOCUMENTS

| | | | |
|---|---|---|---|
| JP | 4-52331 | | 2/1992 |
| JP | 2000205140 A | * | 7/2000 |

OTHER PUBLICATIONS 3 page article entitled "Road RELAY™4", Cummins Engine Company, Inc. (1999), author unknown.

International Search Report for PCT Application No. PCT/US01/43393, mailed Aug. 12, 2002.

* cited by examiner

*Primary Examiner*—Patrick Assouad
*Assistant Examiner*—Manuel L. Barbee
(74) *Attorney, Agent, or Firm*—Watts, Hoffmann, Fisher & Heinke Co., L.P.A.

(57) ABSTRACT

An oil maintenance indicator for recording one or more parameters indicative of when an engine oil filter has been changed. The maintenance indicator includes a sensor that measures oil pressure of an engine at start up. A comparator compares an output provided by the sensor to known parameters to determine whether the oil filter has been changed. A recorder coupled to the comparator records one or several parameters indicative of when the oil filter has been changed.

25 Claims, 3 Drawing Sheets

N: NORMAL PRESSURE BUILD-UP WITH FILLED FILTERS

O/C: DELAYED PRESSURE BUILD-UP WITH EMPTY OIL FILTER(S)

P: PRE-DEFINED PRESSURE LEVEL $T_N$ or $R_N$ : PRE-DEFINED 'NORMAL' TIME OR REVOLUTIONS TO REACH P

T OR R : ACTUAL TIME OR REVOLUTIONS TO REACH P

A: AREA DEFINED BY N ≠ O/C ALT. WAY TO MEASURE

OIL MAINTENANCE INDICATOR

TECHNICAL FIELD

The present invention relates to engine oil change and maintenance monitors. More particularly, the invention relates to a vehicle engine oil change monitor for monitoring oil pressure at start-up to detect an oil filter change and for recording one or more parameters indicative of when the filter and oil was changed.

BACKGROUND ART

As is well known, internal combustion engine oil tends to degrade gradually with the passage of time and operation of a vehicle. The ability of an oil filter to remove contaminants from the engine oil deteriorates as the vehicle is operated. It is necessary to change the engine oil when the oil degrades to a certain unsuitable consistency and the functionality of the filters is impaired. Typically, the oil filter or filters are changed when the engine oil is changed.

Oil is typically changed on a periodic basis as needed. For example, oil may be changed at given intervals of time, given distances traveled by the vehicle, given duty cycles or given periods of time that the vehicle engine has run. If the oil and filter are not regularly changed, the resale value of the vehicle and durability of the engine are drastically reduced. The perception being that poor maintenance will result in reduced durability. Lessors of vehicles and owners of fleets of vehicles want to keep track of the date and mileage when the engine oil and filters are changed on their vehicles. In addition, lessors and fleet owners desire to make certain that the lessee or operator of the vehicle has the oil and filter changed at the required intervals. In the past there was no way of assuring oil and filters have been changed at required intervals, particularly when the vehicles or engines are out of the business's full control.

Prior art oil change interval monitors have monitored the oil level in an oil pan to determine when oil has been changed. Oil level type monitors could determine that oil has been changed, but do not detect an oil filter change. A fleet owner using an oil level monitor could not be sure that the oil filters were changed when the oil was changed.

Oil filters can be changed without changing the engine oil. However, some oil in the head of the engine will typically leak out if the oil filters are changed without first draining the oil from the engine. For this reason, it is unlikely that oil filters will be changed without changing the oil as well.

Accordingly, there is a need for a passive engine oil change monitor which detects oil filter changes and records one or more parameters that indicate when the oil filter was changed. The oil change monitor of the present invention measures oil pressure at start up to determine whether an oil filter has been changed.

DISCLOSURE OF INVENTION

The present invention concerns a method and apparatus for enabling the determination of when an oil filter of a vehicle has been changed. The apparatus includes a sensor, a timer or counter, a comparator, and a recorder. The sensor monitors the oil pressure of an engine. The sensor includes an output for providing a pressure signal representative of the engine oil pressure. The timer or counter is in communication with the sensor. When a timer is used, it measures a time required to achieve a known oil pressure and provides a signal that represents the measured time. When a counter is used, it counts the number of engine revolutions or pulses that are required to achieve a known oil pressure and provides a counter signal that represents the number of counted revolutions or pulses. A comparator is coupled to the timer or counter. The comparator compares the measured time or counted number of revolutions required to achieve the known engine oil pressure to a known time or number of revolutions required to achieve the known pressure. The comparator has a comparator output that provides a comparator signal after an oil filter has been changed. A recorder is coupled to the comparator output. The recorder records data that indicates when the oil filter has been changed. Examples of recorded data include the odometer reading, or number of engine hours and the amount/quantity of fuel used (between filter changes).

In one embodiment, the apparatus includes both a timer and a counter. In this embodiment, a first comparator compares the measured time provided by the timer to a known time. The second comparator compares the number of revolutions counted by the counter to a known number of revolutions. In this embodiment, the recorder is coupled to the first and second comparators. The recorder records an odometer reading, quantity of fuel used, mileage or engine run time when both comparators or one of the comparators indicate that an oil filter has been changed. In one embodiment, the recorded parameters are communicated for service information.

The method of enabling the determination of when an oil filter of an engine has been changed comprises measuring a period of time or number of engine revolutions required to achieve a known engine oil pressure when the engine is started. The measured period of time or number of revolutions is compared to a known period of time or number of revolutions for achieving a known oil pressure. This comparison allows a determination to be made as to whether the oil has filter been changed since a previous start-up. When it is determined that the filter has been changed that event is recorded.

In one embodiment, the known period of time or known number of revolutions is the normal period of time or number of revolutions required to achieve a given oil pressure when the oil filter is full of oil when the engine is started. In a second embodiment, the known period of time or number of revolutions is the period of time or number of revolutions required to achieve a given oil pressure when the oil filter is initially empty when the engine is started. The odometer value, date, engine hours, fuel used, or global position are examples of parameters that may be recorded when it is determined that the oil filter has been changed. In one embodiment, an engine oil change is recorded when it is determined that the measured period of time or counted number of revolutions exceeds the known normal period of time or known number of revolutions.

An oil maintenance indicator constructed in accordance with the present invention detects an oil filter change without requiring the service person to perform any additional tasks when the oil and filter are changed. Not only does this type of maintenance indicator prevent oil and filter changes from going unrecorded, it also inhibits false records of oil maintenance from being created.

Additional features of the invention will become apparent and a fuller understanding obtained by reading the following detailed description in connection with the accompanying drawings.

BEST MODE FOR CARRYING OUT THE INVENTION

Figure 1:
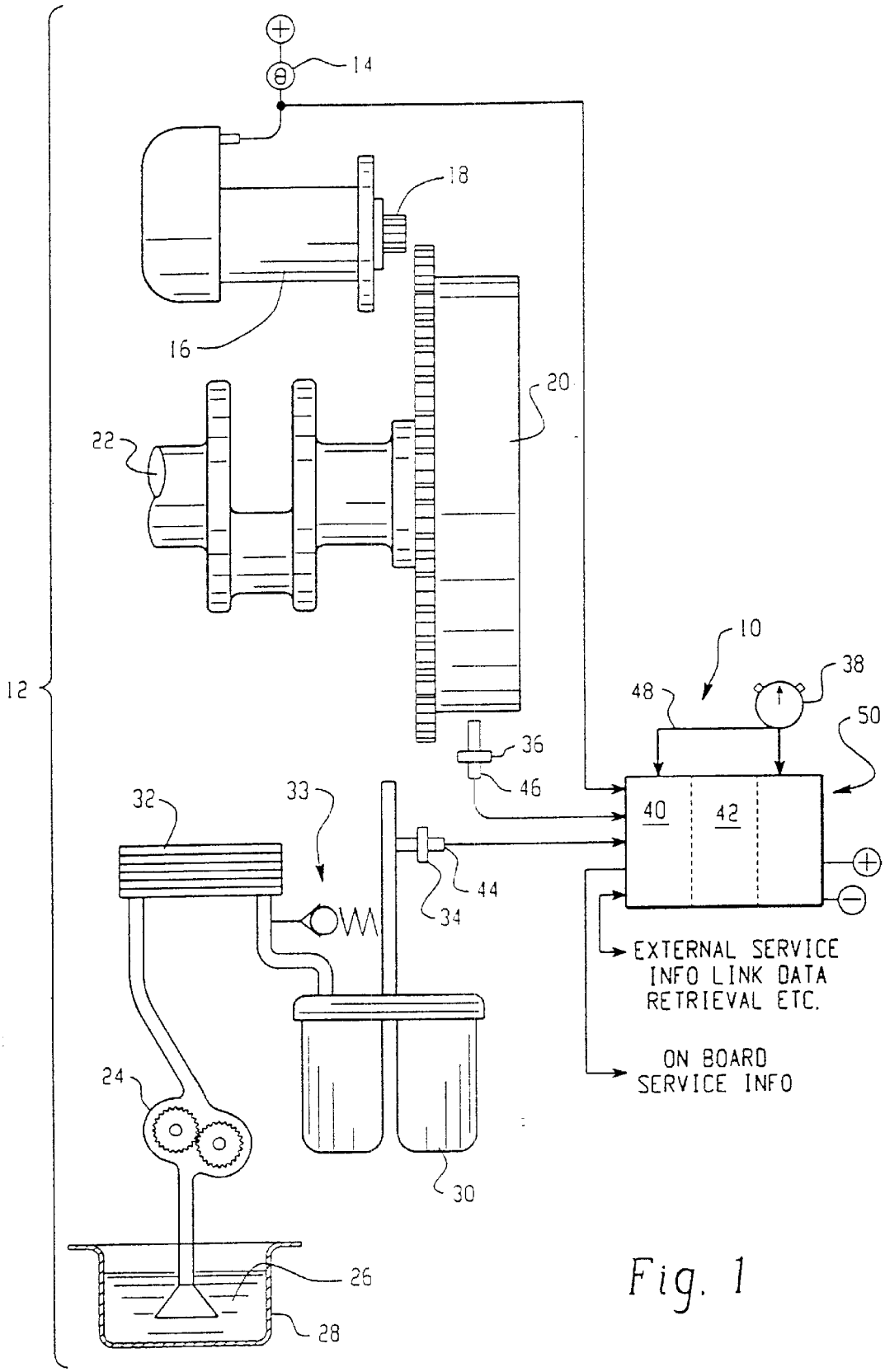
FIG. 1 is a schematic representation of an oil maintenance indicator.

The present invention is directed to an oil change indicator 10 for enabling determination of when an oil filter 30 of an engine 12 has been changed. Referring to FIG. 1, the engine includes a starter key switch 14 electrically connected to a starter motor 16. When the key switch 14 is turned to a start position, voltage is applied to the starter motor 16 causing a drive 18 to rotate. The drive 18 of the starter is coupled to a flywheel 20 and crank shaft 22, such that rotation of the starter drive 18 causes rotation of the flywheel 20 and crankshaft 22. Rotation of the crankshaft 22 causes a corresponding rotation of an impeller mechanism within an oil pump 24. Rotation of the mechanism within the oil pump 24 causes a flow of oil 26 from an oil pan 28 to oil filters 30, an oil cooler 32, the crankshaft 22, and other parts of the engine. As the mechanism of the oil pump 24 begins to rotate, pressure of the oil 26 provided by the pump 24 builds until it reaches a steady state pressure $P_S$ (see FIG. 3). Normally, the oil filters 30 are full of oil 26 when the engine 12 is started. When the oil filters 30 are full of oil, pressure begins to build as soon as the oil pump 24 begins operating. (See curve N of FIG. 3). When the oil filters 30 are changed, the oil filters 30 that are normally full of oil are replaced with new oil filters that are empty. When the engine 12 is started for the first time after the oil 26 and filters 30 are changed, it takes longer for the oil pressure to begin to build, because the oil pump 32 must fill the oil filters 30 with oil 26 before pressure will begin to build up. (See curve O/C of FIG. 3). After the engine stops running, the oil filters remain full.

Most engines have a by-pass valve 33 (see FIG. 1) arrangement to allow for oil passage in case the oil filter has been clogged up by contamination which would be the case if the oil filters are not changed at appropriate intervals.

The oil filters can be of the "spin on" variety which are replaced and disposed of, or they may be "cartridge type" which include a filter media which is cleaned and reused. Another alternative is that there is a replaceable filter insert which is replaceable when an oil canister is cleaned out.

Referring to FIG. 1, the oil maintenance indicator 10 includes a pressure sensor 34, a counter 36 or timer 38, a comparator 40 and a recorder 42. The pressure sensor 34 is coupled to the vehicle engine 12 and monitors the oil pressure of the engine 12. The pressure sensor 34 includes a sensor output 44 that communicates the sensed oil pressure to the comparator 40, which is included in a control and communicating unit in the exemplary embodiment. The pressure sensor 34 monitors the pressure of oil provided by the oil pump 24. In one embodiment, the pressure sensor 34 is an analog sensor that can sense a range of oil pressures. An example of one such sensor is model no. 279A manufactured by Stewart Warner Instrument Corp. In an alternate embodiment, the pressure sensor is a pressure switch that provides a first signal when the oil pressure is below a threshold value and provides a second signal when the oil pressure is greater than the threshold value. One example of a pressure switch is model no. 5000 Series manufactured by Stewart Warner Instrument Corp.

Referring to FIG. 1, the counter 36 is mounted near the engine fly wheel 20. When the starter switch 14 is turned on the starter motor 16 begins rotation of the flywheel 20 and crank shaft 22. The counter 36 counts a number of engine revolutions as the flywheel 20 spins. The revolutions can be measured as a result of cranking by the starter motor or when the key has been released and the engine starts to run by itself It should be apparent to those skilled in the art that movement of other engine parts can be monitored to determine the engine revolutions. The exemplary counter 36 includes an output 46 that represents a number of engine revolutions. One example of a counter is model no. 340020 manufactured by VDO.

In an second embodiment, the counter 36 is replaced with a timer 38. When the starter switch 14 is closed, the starter motor 16 causes rotation of the flywheel 20 and crank shaft 22. The timer 38 measures time after rotation of the crankshaft and flywheel begins which may or may not include the time the starter caused rotation of the crankshaft. The timer 38 includes an output 48 that provides a signal to the comparator 40 that indicates the amount of time elapsed since the crankshaft started rotating. The timer is normally included in the engine or vehicle electronic control unit 50 (ECU). Electronic control units that may be modified in accordance with the present invention are available from, but not limited to, Lucas Electronics, TRW, Motorola and Bosch. In one embodiment, the timer 38 is included with the comparator 40 in a control and communications unit 50.

Figure 3:
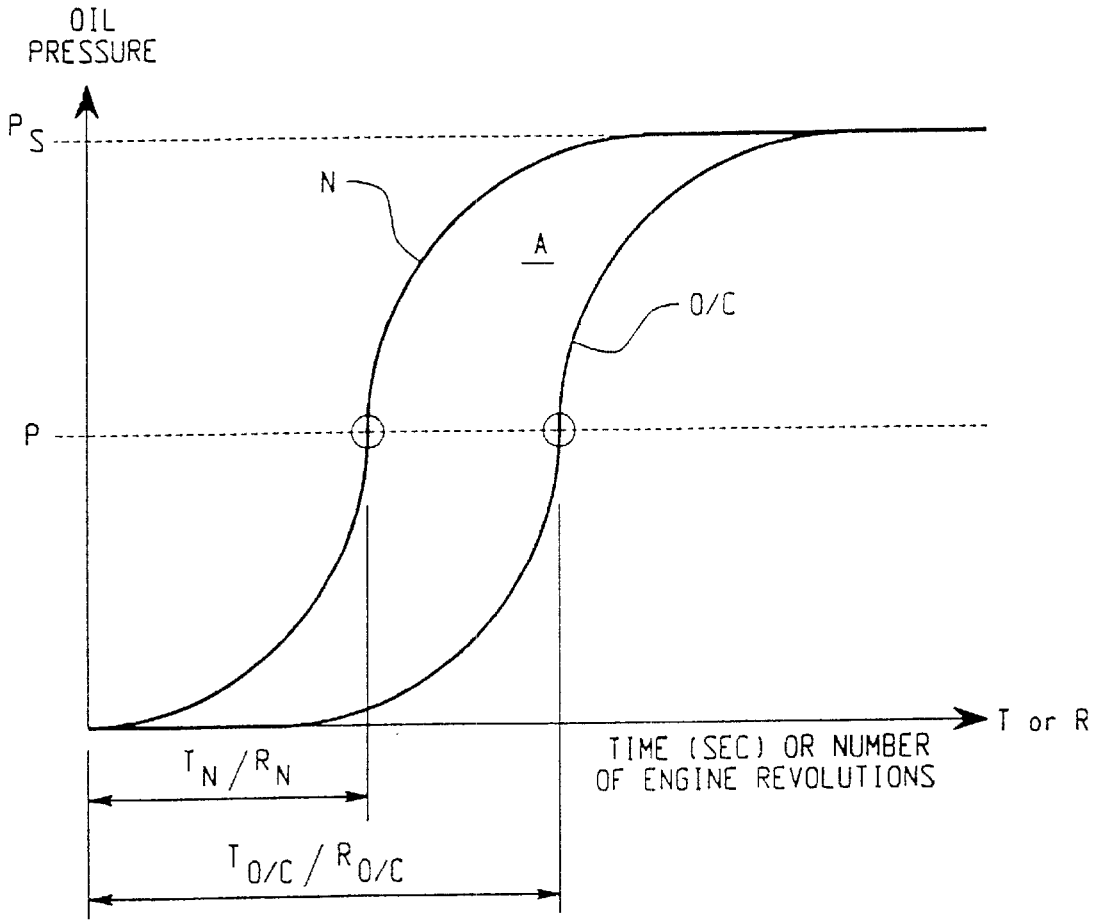

Referring to FIG. 3, the time or number of revolutions typically required to achieve oil pressures ranging from 0 to steady state pressure $P_s$ can be monitored, and recorded. The time or number of revolutions required to achieve a given pressure P is longer during the first start up after the engine oil/filter 26 have been changed, since the oil filters must be filled with oil before pressure begins to build. For a given pressure P the time $T_N$ or number of revolutions $R_N$ normally required to achieve oil pressure and the time $T_{OC}$ or number of revolutions $R_{OC}$ required to achieve oil pressure after an oil and filter change can be easily recorded. When a timer 38 is used, the comparator 40 is coupled to the timer output 48. The comparator 40 compares a measured time required to achieve a given pressure P, supplied by the timer, to the time that is normally required to achieve the given oil pressure P when the oil filters are full.

When a counter 36 is employed, the comparator 40 is coupled to the output 46 of the counter. The comparator 40 compares a number of revolutions required to achieve a given engine oil pressure P counted by the counter 36 to the number of revolutions that is normally required to achieve the given oil pressure P. In one embodiment, the comparator calculates an area enclosed by the curves N and o/c to determine whether the oil filter has been changed.

In one exemplary embodiment, the comparator 40 compares time measured by the timer 38 or the number of revolutions measured by the counter 36 to time $T_N$ or the number of revolutions $R_N$ normally required to achieve a given oil pressure P when the filters 30 are initially full. When the time or number of revolutions provided to the comparator 40 by the timer 38 or the counter 36 is greater than the time $T_N$ or number of revolutions $R_N$ normally required to achieve the given oil pressure P when the filters 30 are full, the comparator 40 provides a signal that indicates that the oil has been changed.

In an alternate exemplary embodiment, the comparator compares the measured time or number of revolutions to the time $T_{OC}$ or the number of revolutions $R_{OC}$ required to achieve the given oil pressure P when filters 30 are empty. When the signal provided to the comparator 40 indicates that the time or number of revolutions required to achieve the given pressure P is approximately equal to the number of revolutions $R_{OC}$ or time $T_{OC}$ required to achieve the selected oil pressure P when the filters 30 are fresh, the comparator 40 provides a signal that indicates that the oil filter has been changed.

Referring to FIG. 1, the comparator 40 is included in a control and communications unit 50, along with the recorder 42 in the exemplary embodiment. When the recorder 42 receives a signal from the comparator 40 that indicates that the oil has been changed, the recorder 42 records a variety of parameters, for example, date, odometer reading, number of engine hours of the vehicle, and quantity of fuel used. In the exemplary embodiment, the recorder 42 is coupled to, or included in, the control and communications unit 50. Recorded data is retrievable from the recorder and could be communicated on board a vehicle to an operator or service person or to external users for service and history purposes. The communications unit 50 provides on board information recorded by the recorder, as well as external service information via an information link. The comparator is normally included in the engine or vehicle electronic control unit 50.

Figure 2:
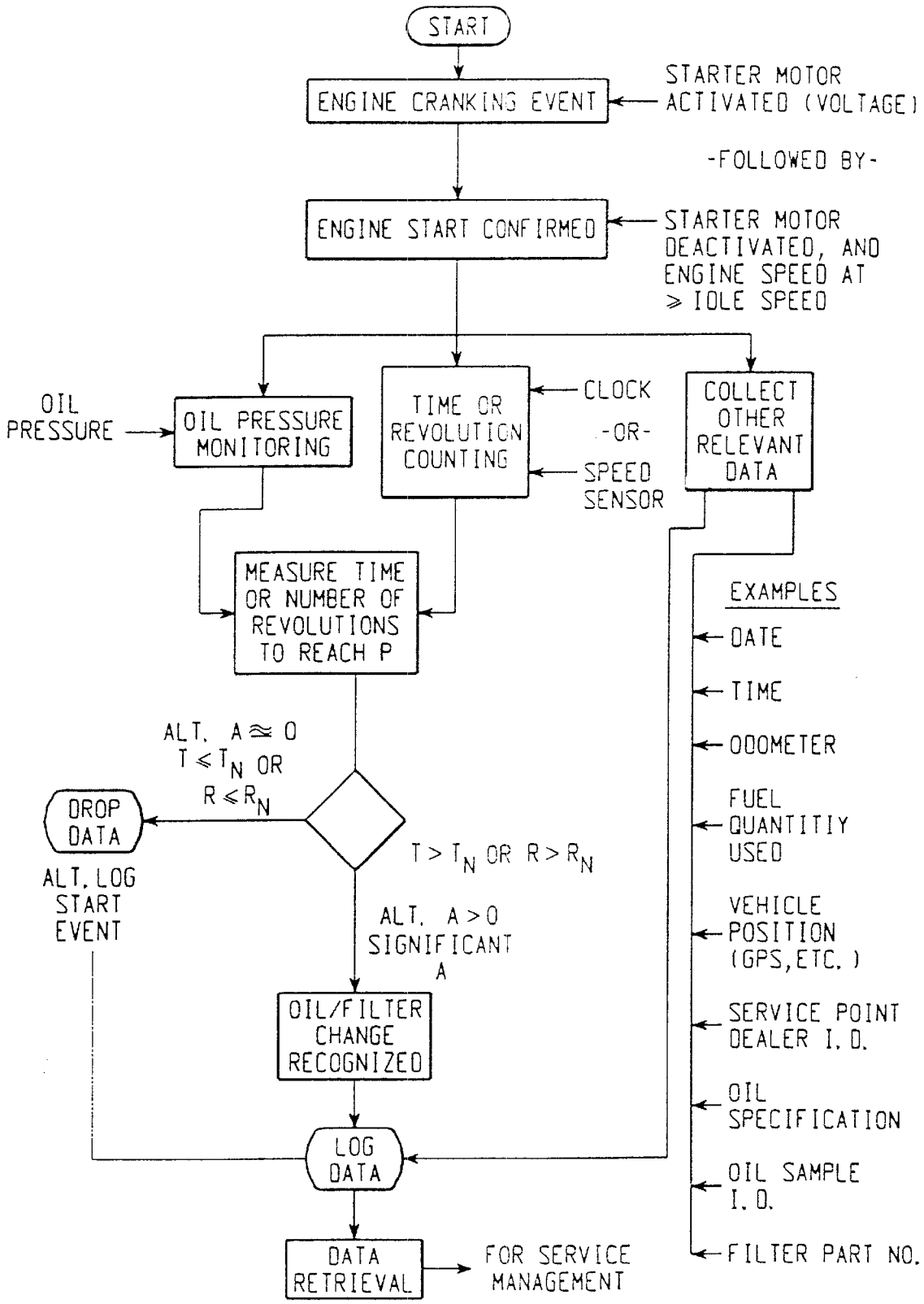
FIG. 2 is a block diagram of steps performed by an oil maintenance indicator and an electronic control unit (ECU); and, FIG. 3 is a plot of oil pressure versus time or revolutions when an engine is started and oil filters are initially full and a plot of oil pressure versus time or revolutions when an engine is started and oil filters are initially empty.

FIG. 2 is a flow chart of the steps performed by the oil change indicator 10 to enable determination of when oil and filters of an engine have been changed. The start event is characterized by the starter switch 14 being turned "on," the starter motor being deactivated and the engine reaching a speed that is greater than or equal to an idle speed. When the starter switch 14 is turned to a "start" position, the starter motor 16 is activated by a voltage provided to the starter motor 16 which causes the engine to crank. The starter motor 16 is then deactivated and engine start is confirmed when the engine speed is greater than or equal to a given idle speed. Once engine start is confirmed, oil pressure, time, number of revolutions, and other relevant data, such as date, odometer reading, amount of fuel used, vehicle position, service point dealer I.D., oil specification, oil sample I.D., and filter part number are monitored.

Referring to FIG. 3, oil pressure is plotted, versus time or number of engine revolutions. The curve labeled N represents the time or revolutions required to achieve oil pressure when the oil filters 30 are normally full of oil. The curve labeled O/C represents the time required to achieve oil pressure when fresh or empty oil filters are present. Referring again to FIG. 2, the time or number of revolutions required to reach a given oil pressure P is monitored by the oil pressure sensor in conjunction with the time sensor or counter. In the exemplary embodiment, if the time or number of revolutions required to reach a given pressure P is less than or equal to the time $T_N$ or number of revolutions $R_N$ normally required to achieve the given oil pressure P the data is dropped in the exemplary embodiment and the process starts over. In an alternate exemplary embodiment, this information is used to record the number of starts over time, as well as of other parameters such as oil pressure, time, number of revolutions, and other relevant data, such as date, odometer reading, amount of fuel used, vehicle position, service point dealer I.D., oil specification, oil sample I.D., and filter part number associated with the given start event. If the time measured is greater than the time $T_N$ or number of revolutions $R_N$ normally required to achieve the given oil pressure P, an oil filter change is recognized. It should be readily apparent to those skilled in the art that the oil change indicator 10 can be configured such that the time measured or number of revolutions counted must be significantly greater than the time $T_N$ or number of revolutions $R_N$ normally required to achieve oil pressure before an oil filter change is recognized to avoid false oil filter change signals.

In an alternate embodiment, the counted number of revolutions or measured time can be compared to the time $T_{OC}$ or revolutions $R_{OC}$ required to reach the given oil pressure P when the oil filters 30 are empty. In this case, an oil filter change will be recognized when the time required $T_N$ or number of revolutions $R_N$ required to achieve the known oil pressure P is equal to or nearly equal to a known time $T_{OC}$ for achieving oil pressure when the oil filters 30 are empty.

In a third embodiment, an area A (see FIG. 3) between the normal pressure curve N and the monitored pressure curve (o/c after the oil and filter have been changed) is calculated to determine whether the oil has been changed since the last "start." In the exemplary embodiment, an oil change is detected when the area "A" between the curves is greater than 0.

When an oil filter change is recognized, relevant data is logged. For example, the fact that the oil and filters have been changed, along with any combination of parameters, such as date, time, the odometer reading, fuel quantity used, vehicle position, service point dealer I.D., oil specification, oil sample I.D., and filter part number when the oil was changed. The external communications unit 50 allows data to be retrieved for service management and provides on board service information.

Although the present invention has been described with a degree of particularity, it is the intent that the invention include all modifications and alterations falling within the spirit and scope of the appended claims.

I claim:

1. A method of enabling the determination when an oil filter of a vehicle engine has been changed, comprising:

a) measuring a period of time required to achieve a known engine oil pressure when the engine is started;

b) comparing the measured period of time to a known period of time for achieving the known oil pressure to determine whether the oil filter has been changed since a previous start up;

c) recording that the engine oil has been serviced when it is determined that the oil filter has been changed.

2. The method of claim 1 further comprising communicating a recorded parameter for service information.

3. The method of claim 1 further comprising recording a fuel quantity used between oil changes.

4. The method of claim 1 wherein said known period of time is a time required to achieve the known engine oil pressure when the engine oil filter is full of oil when the engine is started.

5. The method of claim 1 wherein said known period of time is a time required to achieve the known engine oil pressure when the engine oil filter is empty when the engine is started.

6. The method of claim 1 further comprising recording an odometer value when it is determined that the oil filter has been serviced.

7. The method of claim 1 further comprising recording a date when it is determined that the oil filter has been serviced.

8. A method of enabling the determination of when an oil filter of a vehicle engine has been serviced, comprising:

a) measuring a number of engine revolutions required to achieve a known engine oil pressure when the engine is started;

b) comparing the measured number of revolutions to a known number of engine revolutions required to achieve the known engine oil pressure to determine whether the oil has been changed since a previous start up, c) recording that the engine oil has been changed when it is determined that the oil has been changed.

9. The method of claim 8 further comprising communicating a recorded parameter for service information.

10. The method of claim 9 further comprising recording a fuel quantity used between oil changes.

11. The method of claim 8 wherein said known number of revolutions is a number of revolutions required to achieve the known engine oil pressure when an engine oil filter is full of oil when the engine is started.

12. The method of claim 8 wherein said known number of revolutions is a number of revolutions required to achieve the known engine oil pressure when the oil filter is empty when the engine is started.

13. The method of claim 8 further comprising recording an odometer value when it is determined that the oil filter has been changed.

14. The method of claim 8 further comprising recording a date when it is determined that the oil filter has been changed.

15. A method of enabling determination of when an oil filter of a vehicle engine has been serviced, comprising:

a) measuring a period of time required to achieve a known engine oil pressure when the engine is started;

b) comparing the measured period of time to a known period of time required to achieve the known oil pressure when an oil filter is full; and c) recording a date when the measured period exceeds the known period by a predetermined amount.

16. The method of claim 15 further comprising communicating a recorded parameter for service information.

17. The method of claim 15 further comprising recording a fuel gravity used between oil changes.

18. The method of claim 15 further comprising recording a vehicle odometer reading when the measured period exceeds the known period.

19. A method of enabling determination of when an oil filter of a vehicle engine has been changed, comprising:

a) measuring a number of revolutions required to achieve a known engine oil pressure when the engine is started;

b) comparing the measured number of revolutions to a known number of revolutions required to achieve the known oil pressure when an oil filter is full; and c) recording a vehicle odometer reading when the measured period exceeds the known period by a predetermined amount.

20. The method of claim 19 further comprising communicating a recorded parameter for service information.

21. The method of claim 19 farther comprising recording a fuel gravity used between oil changes.

22. The method of claim 19 further comprising recording a date when the measured period exceeds the known period.

23. An apparatus for enabling determination of when an oil filter of a vehicle has been changed, comprising:

a) a sensor operably connected to said engine that monitors oil pressure, said sensor having a sensor output for providing a pressure signal representative of oil pressure;

b) a timer in communication with said sensor, said timer measures a time required to achieve a known oil pressure and provides a time signal representative of a measured time;

c) a comparator coupled to the timer for comparing a time required to achieve said known oil pressure to a known time for achieving said known oil pressure, said comparator having a comparator output that provides a comparator signal after the oil filter is changed;

d) a recorder coupled to said comparator output, said recorder records a date when said comparator signal indicates that the oil filter has been changed.

24. An apparatus for enabling determination of when an oil filter of an engine has been changed, comprising:

a) a sensor operably connected to said engine that monitors oil pressure, said sensor having a sensor output for providing a pressure signal representative of oil pressure;

b) a counter in communication with said sensor, said counter counts a number of engine revolutions required to achieve a known oil pressure and provides a counter signal representative of said number of revolutions;

c) a comparator coupled to the counter for comparing the number of revolutions required to achieve said known pressure to a known number of revolutions required to achieve said known oil pressure, said comparator having a comparator output that provides a comparator signal after the oil filter is changed;

d) a recorder coupled to said comparator output, said recorder records a date when said comparator signal indicates that the oil filter has been changed.

25. An apparatus for determining when an oil filter of a vehicle has been changed, comprising:

a) a sensor operably connected to said engine that monitors oil pressure when said engine is started, said sensor having a sensor output for providing a pressure signal representative of oil pressure when said engine is started;

b) a timer in communication with said sensor, said timer measures a time required to achieve a known oil pressure and provides a time signal representative of said measured time;

c) a first comparator coupled to said timer for comparing a measured time required to achieve said known oil pressure to a known time for achieving said known oil pressure, said comparator having a comparator output that provides a comparator signal when said measured time exceeds said known time;

d) a counter in communication with said sensor, said counter counts a number of engine revolutions required to achieve said known oil pressure and provides a counter signal representative of said number of revolutions;

e) a second comparator coupled to the counter for comparing a counted number of revolutions required to achieve a known oil pressure to a known number of revolutions for achieving said known oil pressure, said comparator having a comparator output that provides a comparator signal when said counted number exceeds said known number, f) a recorder input coupled to said first and second comparator outputs, said recorder records an odometer reading when said comparator signal indicates that the oil filter has been changed; and, g) a communicator coupled to said recorder for communicating a recorded parameter for service information.

* * * * *